US009988755B2

(12) United States Patent
De Pellegrin et al.

(10) Patent No.: US 9,988,755 B2
(45) Date of Patent: Jun. 5, 2018

(54) HOUSEHOLD APPLIANCE

(71) Applicant: Electrolux Appliances Aktiebolag, Stockholm (SE)

(72) Inventors: Andrea De Pellegrin, San Foca di San Quirino (IT); Stefano Morandini, San Vito al Tagliamento (IT); Rodolfo Marcuz, Pordenone (IT)

(73) Assignee: Electrolux Appliances Aktiebolag (SE)

( * ) Notice: Subject to any disclaimer, the term of this patent is extended or adjusted under 35 U.S.C. 154(b) by 0 days. days.

(21) Appl. No.: 15/391,900

(22) Filed: Dec. 28, 2016

(65) Prior Publication Data

US 2017/0183808 A1 Jun. 29, 2017

(30) Foreign Application Priority Data

Dec. 29, 2015 (EP) ..... 15203004

(51) Int. Cl.
*D06F 39/00* (2006.01)
*D06F 39/12* (2006.01)
(Continued)

(52) U.S. Cl.
CPC ..... *D06F 39/12* (2013.01); *D06F 39/005* (2013.01); *D06F 58/20* (2013.01); *A47L 15/4293* (2013.01); *D06F 58/28* (2013.01); *D06F 2216/00* (2013.01)

(58) Field of Classification Search
CPC ..... D06F 39/12; D06F 39/005; D06F 37/266; D06F 58/28; D06F 58/20; D06F 2216/00; F25D 29/005; F25D 23/02; F25D 23/028; F25D 23/04; F25D 23/00; F25D 23/025; F25D 2323/023; F25D 2400/361;
(Continued)

(56) References Cited

U.S. PATENT DOCUMENTS 4,970,870 A * 11/1990 Midlang ..... F25D 29/00 236/94
5,243,453 A * 9/1993 Kawaguchi ..... D06F 39/005 349/122
(Continued)

FOREIGN PATENT DOCUMENTS

CN 1683667 A 10/2005
DE 19651821 A1 6/1998
(Continued)

OTHER PUBLICATIONS

English translation of DE102010063014.*
Extended European Search Report issued in corresponding European Application No. 15203004.5, dated Jun. 20, 2016.

*Primary Examiner* — Hiwot E Tefera
(74) *Attorney, Agent, or Firm* — RatnerPrestia

(57) ABSTRACT

A household appliance (2) has a frontal panel (48) with a front side (62) facing the outside of the appliance (2) in an assembled state and a rear side (64) opposite to the front side (62) facing the interior of the appliance (2) in an assembled state and with an aperture (58). The appliance further has a cover element (60) covering the aperture (58) on the front side (62), and a receptacle (78) arranged on the rear side (64) behind the aperture (58). The receptacle (78) has a sealing element (86) which in an assembled state is in contact with the covering element (60), thereby providing a sealed space between the cover element (60) and the sealing element (86).

14 Claims, 5 Drawing Sheets

(51) Int. Cl.
*D06F 58/20* (2006.01)
*A47L 15/42* (2006.01)
*D06F 58/28* (2006.01)

(58) Field of Classification Search
CPC .. F25D 2400/36; F25D 29/00; A47L 15/4293; A47L 15/4251
USPC ..... 312/263, 265.5, 265.6, 228
See application file for complete search history.

(56) References Cited

U.S. PATENT DOCUMENTS 5,584,563 A * 12/1996 Stottmann ..... A47L 15/4293 116/DIG. 28
7,156,632 B2 * 1/2007 Park ..... B29C 45/14065 425/112
7,215,390 B2 * 5/2007 Morsch ..... A47L 15/4293 349/58
7,483,092 B2 * 1/2009 Morsch ..... A47L 15/4293 349/58
7,903,399 B2 * 3/2011 Kim ..... G02F 1/133308 312/223.1
8,327,671 B2 * 12/2012 Kim ..... D06F 39/005 68/12.27
9,255,355 B2 * 2/2016 Bas ..... D06F 39/005
9,428,855 B2 * 8/2016 Park ..... D06F 39/005
9,803,309 B2 * 10/2017 De Pellegrin ..... D06F 39/005
2003/0115891 A1 * 6/2003 Raab ..... F24C 7/082 62/126
2006/0219697 A1 * 10/2006 Geiger ..... A47L 15/4293 219/445.1
2007/0068029 A1 * 3/2007 Kwon ..... D06F 39/005 34/88
2007/0119484 A1 * 5/2007 Kwon ..... D06F 39/005 134/58 R
2008/0259591 A1 * 10/2008 Kim ..... D06F 39/005 362/89
2012/0061136 A1 * 3/2012 Hultgreen ..... F25D 29/005 174/520
2012/0138042 A1 * 6/2012 Huntscha ..... F24C 7/083 126/211
2013/0025579 A1 * 1/2013 May ..... F24C 7/00 126/19 R
2013/0091904 A1 * 4/2013 Kim ..... A47L 15/4293 68/3 R
2014/0049926 A1 * 2/2014 Bas ..... D06F 39/005 361/759
2014/0145579 A1 * 5/2014 Anderson ..... F25D 29/005 312/404
2015/0122825 A1 * 5/2015 Sung ..... G06F 3/044 220/592.1
2016/0187003 A1 * 6/2016 Wojcik ..... F24C 15/12 126/214 B

FOREIGN PATENT DOCUMENTS

DE 20210707 U1 11/2003
DE 102010063014 A1 * 6/2012 ..... D06F 39/005
EP 1176619 A2 1/2002
EP 1645679 A2 4/2006
EP 1970479 A2 9/2008
EP 2458060 A1 5/2012
EP 2837726 A1 2/2015
EP 2876196 A1 5/2015

* cited by examiner

HOUSEHOLD APPLIANCE

CROSS-REFERENCE TO RELATED APPLICATION

This application claims priority to European Application No. 15203004.5 filed Dec. 29, 2015, the content of which is hereby incorporated by reference in its entirety.

FIELD OF THE INVENTION

The invention generally refers to a household appliance, especially a front/top loading washing machine, dryer or combined washer and dryer, both for domestic and professional use. In particular it refers to a household appliance with a frontal panel with a front side facing the outside of said appliance in an assembled state and a rear side opposite to said front side facing the interior of said appliance in an assembled state and with an aperture, said appliance further comprising a cover element covering said aperture on said front side, and a receptacle arranged on said rear side behind said aperture.

BACKGROUND OF THE INVENTION

Laundry machines such as washing machines, dryers, especially tumble dryers, and combined washers/drawers are known which comprise a front panel with a user interface. On the latter, typically a thin inlay is provided which is usually transparent and sometimes equipped with an intermediate decoration panel. The inlay is usually attached to the frontal surface of said front panel by a bi-adhesive tape. Furthermore, a connection to the frontal surface can be provided by peripheral teeth on one side of the inlay which are configured to be inserted in respective slots on the front panel.

Additionally or alternatively, such inlay can be connected to the frontal surface through screw means.

Household appliances typically comprise user interface with user elements with which the user can interact with the appliance and/or a display for displaying status information on the state of the appliance, i.e. the selected treatment program, error messages etc. Such interface elements or display elements can be arranged behind the inlay to avoid protrusions from the user interface and to give the appliance an attractive look and feel. The corresponding electronic components are therefore arranged on the inside of the frontal panel and are subject to the conditions inside the appliance.

CN 1683667 A discloses a control panel, a status display substrate, an isolator and a rectangular spacer. Sealing components are provided which prevent water to penetrate into the control panel.

SUMMARY OF SELECTED INVENTIVE ASPECTS

An object of the invention is to provide a household appliance with allows reliable protection of electrical components, especially related to the user interface.

It is a further object of the present invention to provide a method for assembling a laundry treatment appliance with these components.

In a first aspect, the invention therefore relates to a household appliance, comprising a frontal panel with a front side facing the outside of the appliance in an assembled state and a rear side opposite to the front side and with an aperture, said appliance further comprising a cover element covering the aperture on the front side, and a receptacle arranged on the rear side behind the aperture, whereby the receptacle comprises a sealing element which in an assembled state is in contact with the covering element, thereby providing a sealed space between the cover element and the sealing element.

Aspects of the invention are based on the consideration that the front panel of laundry treatment appliance is an important component of the appliance since it provides the possibility for its user to operate the machine, for instance to select an overall laundry treatment program and/or to select parameters of a laundry treatment program and/or to visually check said programs/parameters. The user interface therefore typically comprises electronic user interface elements such as buttons, touch controls, or displays.

These components are therefore on the one hand arranged close to the outside of the appliance to be accessible by the user behind a cover. One the other hand, their arrangement inside the machine renders these components subject to conditions appearing in the machine which can alter or destroy their functionality. They can, for instance, be damaged by steam, water or contaminating particles inside the machine.

Applicant has found that a reliable protection of the respective electric component with respect to these harmful influences can be achieved by arranging the component in a receptacle and by providing a sealing element which seals the space in which the electric component is arranged, thereby defining a dedicated and protected space for the respective component.

The household machine in a preferred embodiment is laundry treatment machine. The terms laundry treatment appliance or laundry machine or laundry treatment device includes washing machines as such but also combined washing/drying machines that can incorporate both functionalities. Also the terms laundry washing machine and washing machine are used interchangeably. The laundry machine can, for instance, be designed as a front-loading laundry washing machine. Alternatively, the appliance can be a dryer.

The assembled state denotes the state of the household appliance in which the front panel, receptacle, and cover element are attached to each other for the use of the appliance by a user. These components are therefore arranged and are fixed.

The aperture is preferably designed as an opening. Preferably, the opening has an essentially rectangular shape, most preferably with rounded corners.

The sealing element is preferably built as a gasket. Preferably, the gasket is dimensioned to pass through the aperture of the front side of the frontal panel, allowing the contact between the gasket and the cover element.

In a preferred embodiment, the gasket is co-molded on said receptacle, yielding a firm and tight placement on the receptacle.

The gasket is preferably made of rubber. This choice of material allows to conduct the process of over-injection in a melted state; and in the final state the gasket is elastic and durable.

Advantageously, the gasket comprises an elastically moveable lip, wherein in the assembled state, the lip is in elastic contact with the cover element. This design allows compensating for tolerances occurring in the manufacturing process and in the spatial arrangement in the assembled state and still provides the desired sealing effect.

The receptacle preferably comprises at least partially at its periphery a step-like structure.

In a preferred embodiment the receptacle comprises a frame with a wall which is essentially perpendicular to the cover element in an assembled state, whereby the gasket comprises an L-shaped part with one first side aligned parallel along the wall and one side perpendicular to the first side covering an edge of the wall which is facing the cover element.

The elastically moveable lip is advantageously connected to the L-shaped part.

The cover element is preferably at least partially transparent, allowing the user to recognize a user interface element which is arranged behind the cover element.

In a preferred embodiment, the cover element is a window or an inlay.

Advantageously, at least one electronic component is arranged in the receptacle, preferably behind or passing the aperture.

In a preferred embodiment, the electronic component is a display, whereby the cover element is an at least partially transparent window. The display preferably displays information regarding the current state of the household appliance, for instance the selected program and/or options thereof, instructions to the user, for instance for loading, unloading the appliance, or error codes. The display is preferably a TFT-display. Due to the necessity of view the display from an external side, it must be placed in the proximity of the rear side of the transparent cover; by the sealing effect between the sealing element and the cover, the protection as well as the appearance of the frontal panel is improved.

In order to allow a convenient assembly of the related components, the display is preferably arranged on a carrier element which is attached to the receptacle or to an electronic board. In the latter case, the electronic board is preferably attached to the receptacle.

In an alternative embodiment, the display is carried on the receptacle.

Advantageously, the electronic component is a user interface element.

In a first preferred embodiment, the user interface element is a resistive touch-sensitive user interface element, wherein the cover element is an elastic inlay, thereby allowing a user to exert pressure on the touch-sensitive user interface element by pressing on the inlay. The inlay in this way deforms itself elastically, allowing the user to exert pressure also on the resistive touch-sensitive user interface element.

In a second preferred embodiment, the user interface element is a capacitive touch-sensitive user interface element, whereby the inlay is capacitive and in contact with the user interface element, allowing the user interface element to determine the location of a touch event.

In a different variant, the user interface element is a capacitive touch-sensitive user interface element, whereby the inlay on its side facing the user interface element comprises a conductive film. In this way, changes in the electric field of the user interface element can be affected by a finger of a user touching the inlay.

The user interface element can also have the properties of a display, i.e. it can be built as capacitive or resistive touch display, displaying information to the user and reacting to user input. The display can also display one or more areas on which the user can click/touch to interact with the appliance.

The front panel preferably comprises a user interface. The user interface preferably comprises at least one user interface element for interacting with the appliance. The user interface can also comprise further elements such as a display and/or light elements for indicating the current status of the appliance, a selected program, option thereof and/or error message.

Advantageously, a rotatable user interface element is arranged on the user interface. The rotatable user interface element is preferably built as a rotatable knob. The rotatable knob preferably is built as a push knob, thereby allowing the user to turn the knob and also to push it down. In this way, by way of example, by rotating the knob, the user can make a selection, and by pushing it, she or he can confirm this selection.

In a second aspect, the invention relates to a method for manufacturing a household appliance, comprising a frontal panel with a front side facing the outside of the appliance in an assembled state and a rear side opposite to the front side facing the interior of the appliance in an assembled state and with an aperture, said appliance further comprising a cover element covering the aperture on the front side outside, and a receptacle arranged on the rear side behind the aperture, whereby

- a gasket is co-molded to the receptacle;
- the receptacle is mounted at the rear side of the frontal panel;
- a cover element is mounted on the frontal panel covering the aperture.

The electronic component can be arranged on an electronic board which is attached to the receptacle. The spatial arrangement of the electronic component on the electronic board is done in such a way that in the mounted state, the electronic component is arranged behind or in proximity of the aperture.

The last two steps of mounting the receptacle to the frontal panel and mounting the cover element can be performed in the time order as written above or vice versa.

Advantages of aspects of the invention are especially as follows. By sealing a space between sealing element and cover element, a protected dedicated space is created for protecting an electronic component from harmful conditions inside the appliance, thereby prolonging lifetime and functionality of the electronic component. A gasket as a sealing element provides especially good sealing against steam or water. An elastic lip as part of the gasket allows a reliable and sealed fit of receptacle and cover.

BRIEF DESCRIPTION OF THE DRAWINGS

Further features and advantages of the present invention shall become clearer from the following detailed description of some of its preferred embodiments, made with reference to the attached schematic drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings.

Identical parts in these figures are labelled by the same reference numerals.

DETAILED DESCRIPTION OF EXAMPLE EMBODIMENTS

Figure 1:
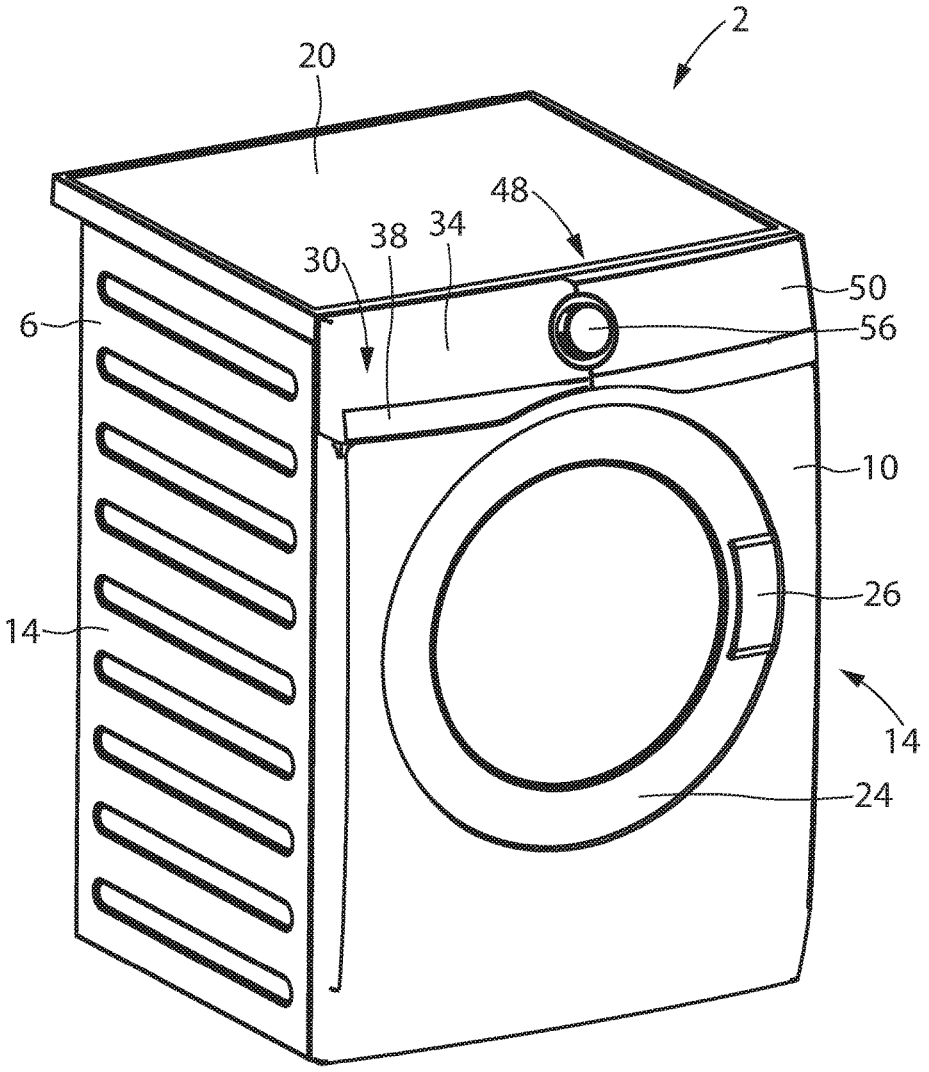
FIG. 1 shows front loading washing machine with a front panel and an inlay in a preferred embodiment.

In FIG. 1, a laundry treatment appliance 2 is shown which is built as a front-loading washing machine and comprises a housing or casing 6 with a preferable parallelepiped shape, the casing 6 comprising a front wall 10, two side walls 14, a cover plate 20 and a rear wall (not shown). Front wall 10 and side walls 14 are preferably part of a cabinet. A front door 24 with a handle 26 is provided which can be opened for loading or unloading laundry through an opening into a washing drum.

Advantageously a washing tub is contained within casing 6, whereby a rotatable and perforated drum is contained by said washing tub. Both washing tub and drum have a substantially cylindrical shape. Advantageously the tub is suspended in a floating manner inside casing 6 by means of a number of coil springs and shock absorbers. The drum is rotated by an electric motor (not shown), which transmits the rotating motion of a motor shaft to the drum by a belt/pulley system. In a different embodiment of the invention, the motor can be directly associated with the shaft of the drum. The tub is preferable connected to casing 6 by means of an elastic bellows or gasket. Alternatively, the laundry appliance can be a dryer (in which case the tub is not provided) or a combined washer and dryer.

The preferred washing machine shown in FIG. 1 comprises a frontal panel 48 comprising a drawer 30 with a front plate 34 and a handle 38 for pulling out and pushing back in drawer 30. Drawer 30 comprises at least one compartment for detergent or washing additives. Adjacent to drawer 30, a user interface 50 is provided. On user interface 50, preferably a user interface element is provided which allows a user to interact with the appliance 2. In the current embodiment, a rotatable knob 56 is provided.

Figure 2:
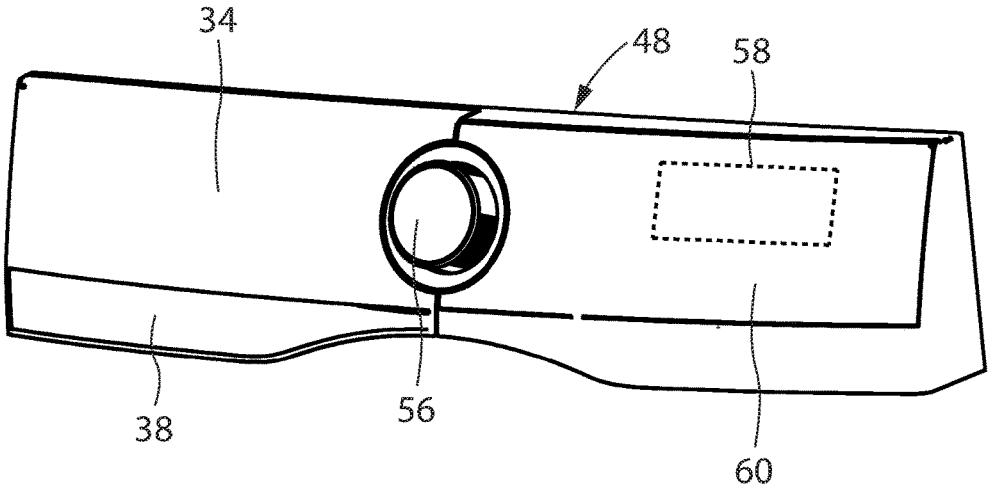
FIG. 2 shows the front panel of laundry washing machine according to FIG. 1.

The frontal panel 48 is shown in a perspective view in FIG. 2. An aperture 58 with a preferably rectangular shape is provided on frontal panel 48. A cover element 60 is at least partially covering the aperture 58. Frontal panel 48 comprises a front side which in the assembled state of the appliance 2 faces the outside of the appliance 2 and, opposite to front side, a back or rear side, which in the assembled state faces the interior of appliance 2.

Figure 3:
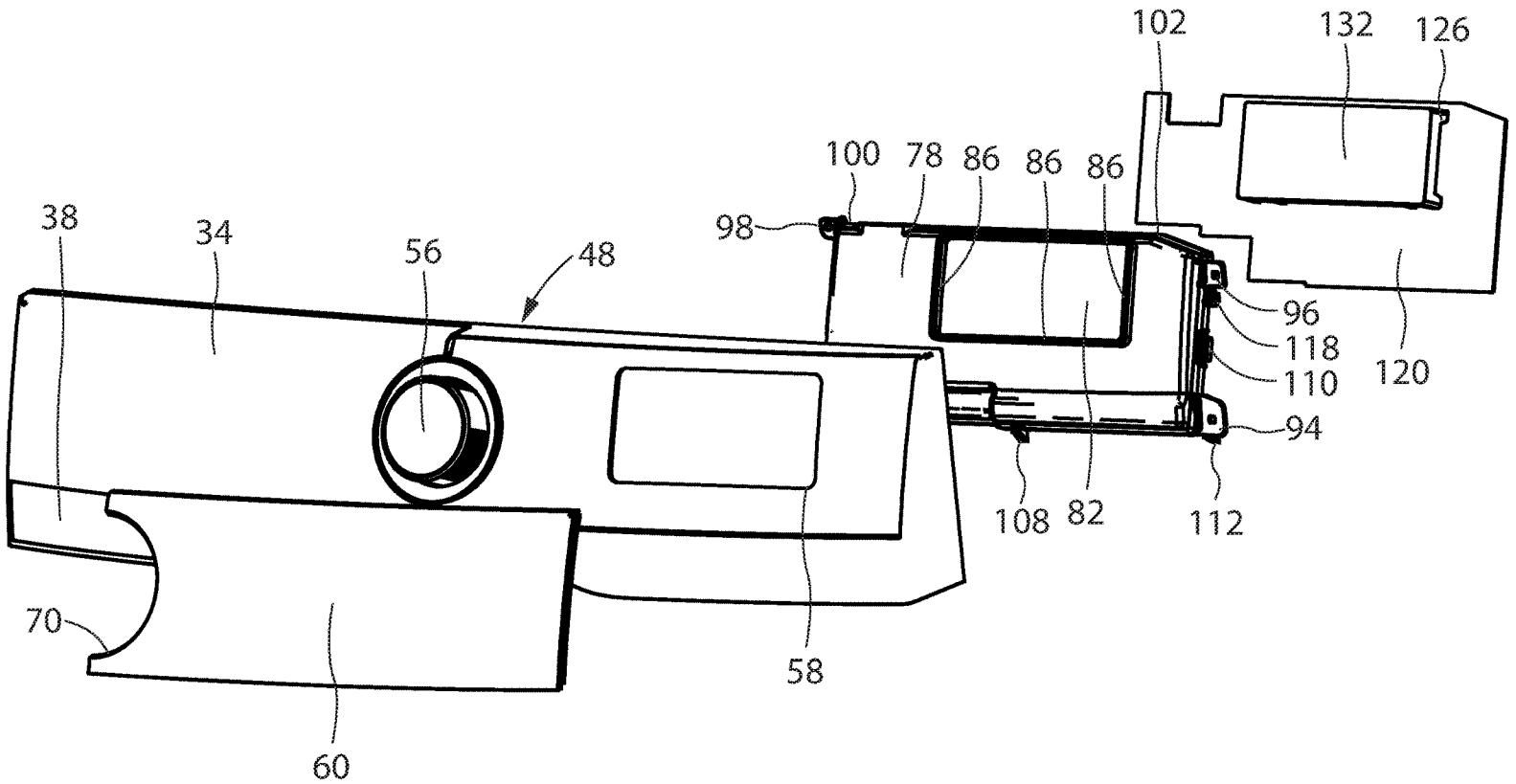
FIG. 3 shows an explosive view of the frontal panel, the inlay and components arranged behind the inlay.

In FIG. 3, a perspective and exploded view is shown of the components shown in FIG. 2 in an assembled state. Cover element 60 is in the preferred embodiment built as an at least partially transparent window. Cover element 60 can have the same transparency across its whole area or can have areas which are more transparent than others. For instance, the area of the cover element 60 which in the assembled state covers aperture 58 can be made partially or essentially fully transparent, while the surrounding area of cover element 60 can have a different and/or varying grade of transparency. Cover element 60 preferably has on its side facing drawer 30 a cutaway region 70 formed essentially as a semicircle and which yields space to the rotatable knob 56.

A receptacle 78, which in the assembled state preferably receives an electronic board, preferably comprises an essentially rectangular shaped opening 82; preferably, the opening 82 corresponds to the opening 58 of the frontal panel, in terms of shape/dimensions. As will be discussed in connection with FIGS. 5 to 7, at the border of this opening 82, a sealing element 86 is provided which in the assembled state is in contact with, i.e. is touching, cover element 60 from a rear side which in the assembled state is facing the interior of the appliance 2. Receptacle 78 preferably comprises laterally protruding flaps 94, 96, 98 which, respectively, comprises a hole for insertion of a fixing element. Receptacle 78 further preferably comprises snap elements 100, 102. Receptacle 78 further preferably comprises curved protrusions 108, 112. Said flaps, snap elements and curved protrusions are preferably suitable for the connection of the receptacle 78 with the front panel 48 and/or with a cover (not shown) closing said receptacle.

An electronic board 120 in the assembled state is preferably mounted to receptacle 78. On the electronic board 120, a carrier element 126 is preferably mounted on which a display 132 is arranged. Display 132 and carrier element can be built as two separate pieces which are connected to each other. They can alternatively be constructed in a single-piece design.

Display 132 is an electronic component which in the assembled state is placed in or behind/in proximity of the aperture 58 and behind cover element 60.

Figure 4:
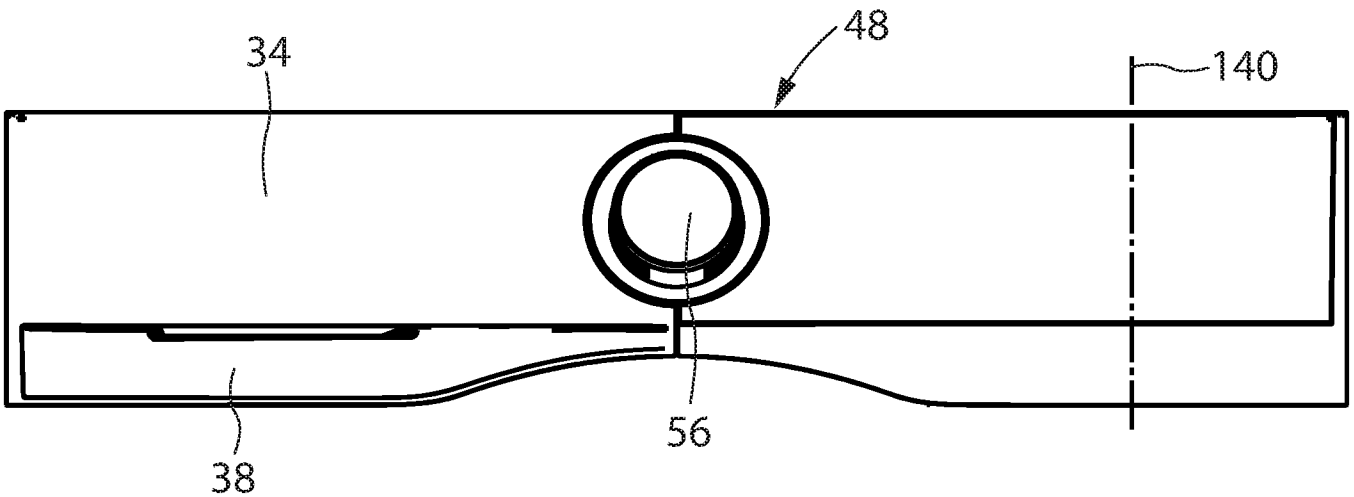
FIG. 4 shows a frontal view of the frontal panel in an assembled state.
Figures 5, 6, 7:
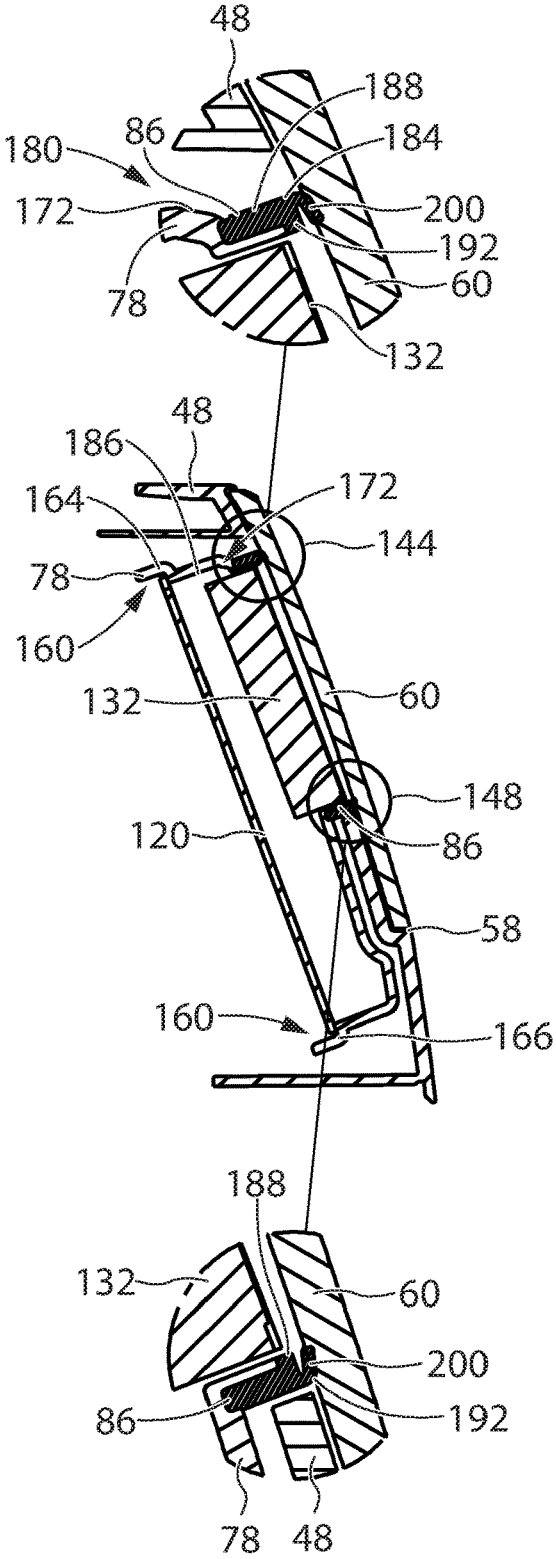
FIG. 5 shows a cut through the front panel shown in FIG. 4 along line 140.
FIG. 6 shows a magnified detail of FIG. 5.
FIG. 7 shows another magnified detail of FIG. 5.

In FIG. 4, the components shown in FIG. 3 are displayed in an assembled state in a frontal view. A section along a line 140 is displayed in FIG. 5. FIGS. 6 and 7 show, respectively magnified encircled regions 144, 148 of FIG. 5.

In connection with FIGS. 5-7, the configuration of receptacle 78, cover element 60, electronic board 120, display 132 and sealing element 86 is discussed. Cover element 60, which presently is a window, is attached to frontal panel 48. This attachment is preferably done in a removable way. Cover element 60 therefore preferably comprises at least one connection element that is connectable/connected to an engagement structure provided on the front side of frontal panel 48. Preferably at least one fixation element is provided on this front surface, restraining the cover element 60 with respect to front panel 48.

In addition or alternatively as the only fixing means, the window or inlay can be attached to frontal panel by means of a bi-adhesive tape. The electronic board 120 is attached to receptacle 78 preferably in a removable connection, preferably by snap means or a screw connection. Display 132 is arranged within receptacle 78 and is preferably placed at least partially within opening 82 in receptacle 82. Display 132 is also preferably placed behind aperture 58 in frontal panel 48 which is covered by cover element 60.

As can be seen in the cross sectional view of FIG. 5, receptacle 78 comprises a first step-like structure 160 which in the interior encompasses electronic board 120. In the present embodiment, this structure 160 is built at two parallel edges 164, 166 of receptacle 78, whereby in the assembled state, edge 164 is an upper edge of receptacle 78 and edge 166 is a lower edge of receptacle 78. This step-like structure 160 results in a narrowing of receptacle 78 in a direction from the electronic board 120 to cover element 60.

Receptacle 78 comprises a second step-like structure 172 which is closer to cover element 60 than first step-like structure 160 and leads to a further narrowing down of receptacle 78 in the direction from the electronic board 120 facing the interior of the appliance 2 and cover element 60 facing the outside of the appliance 2. These two step-like structures 160, 172 allow the receptacle 78 to be wider in an interior region and to be more narrow in a region closer to cover element 60. In this way, it can be fitted conveniently in the narrow space that is available in the frontal panel and still allow a convenient insertion of the display 132. Preferably, the receptacle 78 and the electronic board 120 enclosed inside receptacle 78 are closed by a cover (not shown) suitable to be assembled with said receptacle 78.

In the appliance 2, the space in which the display 132 is arranged is sealed against water, steam or contaminating particles and thereby the display 132 is prevented from suffering malfunctions getting destroyed. This sealing is achieved by the aforementioned sealing element 86 which in the present embodiment is preferably built as a gasket which co-molded to receptacle 78 and over-injected on receptacle 78. As can be seen in FIG. 3, the sealing element 86 is preferably co-molded to receptacle 78 along the full periphery of opening 82; as depicted in FIGS. 3 and 5, the sealing element 86 is preferably configured to pass through the aperture 58 of the front side of the frontal panel 48, allowing the contact between said sealing element 86 and the cover element 60.

The second step-like structure is preferably part of a frame 180 with a wall 186 which is in the assembled state shown essentially perpendicular to cover element 60. The gasket preferably comprises an L-shaped part 184 with a first side 188 aligned parallel along wall 186 and second side 192 perpendicular to the first side 188 covering an edge of wall 186 which is facing cover element 60. This configuration, which is obtained by over-injection, leads to an especially strong connection of the gasket to the receptacle.

The gasket preferably further comprises an elastic lip 200 which is a part of the gasket and which in the assembled state is closest to cover element 60. The gasket is preferably built in such a way that elastic lip 200 protrudes or extends way from second side 192 of L-shaped part 184 in a state where no force is exerted on lip 200. When the receptacle 78 is attached to frontal panel 48, the elastic lip 200 is getting in contact with cover element 60 and is elastically bent until the final relative position between gasket and cover element 60 is reached. Since the elastic lip is pressing against cover element 60, it is assured that a sealed space between gasket and cover element 60 is created in which in the present embodiment the display is protected.

In FIG. 7, another magnified region of FIG. 5 is displayed, wherein the sealing element 84 with is elastic lip 200 is again visible.

The assembly of these components is preferably done as follows, see FIGS. 3-7. The gasket is molded to receptacle 78, which in the present embodiment is built essentially as a box for receiving an electronic board. The gasket therefore is over-injected over receptacle 78. Receptacle 78 is therefore preferably placed in a mold, into which liquid material, preferably rubber, is introduced to then form the gasket.

Preferably the display 132 is first mounted on the electronic board which is then attached to receptacle 78 in such a way that the display is placed behind/in proximity of the aperture 82 in the assembled state. In a next assembly step, receptacle 78 is attached to frontal panel 48 on its rear side so that the display is placed behind/in proximity of the aperture 58 of the front panel. The receptacle 78 is preferably attached to frontal panel 48 by a removable connection such as by a snap connection and/or by screw passing through the holes provided on the protruding flaps 94, 96, 98. In a further assembly step, cover element 60 is mounted on the front side of frontal panel 48 in such a way that is covers aperture 58. While cover element 60 is mounted on frontal panel 48, it is pushed or pressed against elastic lip 200, creating a sealed space for display 132.

In another preferred variant, the cover element 60 can be mounted on frontal panel 48 first before the receptacle 78 is attached to the frontal panel 48 on its rear side.

Instead of the display 132, in other preferred embodiments a different electronic component such as a user interface element is arranged behind aperture 58.

In a preferred variant, this user interface element is a TFT display. In another preferred embodiment, the user interface element is a capacitive touch element, especially a capacitive sensor. The cover element 60 is then preferably built as a capacitive inlay which is in contact with the capacitive touch element such that a touch event on the inlay is detectable by the capacitive touch element. In an alternate embodiment, the inlay on its side facing the capacitive touch element can comprise a capacitive film which allows touch events on the inlay to be detected by the capacitive touch element.

Preferably the front panel 48 with receptacle 78 attached to it is finally mounted to the appliance 2 in a preferably removable way.

The invention thus conceived can be subjected to numerous modifications and variants all falling within the scope of the inventive concept.

In addition, all details can be replaced by other technically equivalent elements.

In practice, all the materials used, as well as the shapes and contingent dimensions, may vary depending on the requirements without departing from the scope of protection of the following claims.

The invention claimed is:

1. A household appliance, comprising:

an external frontal panel with a front side facing the outside of said appliance in an assembled state and a rear side opposite to said front side facing the interior of said appliance in an assembled state and with an aperture;

a cover element attached to the front side of the external frontal panel and covering said aperture on said front side; and a receptacle attached to said rear side of the external frontal panel behind said aperture, wherein said receptacle comprises a sealing element which in an assembled state extends through said aperture of said external frontal panel and contacts said cover element, thereby providing a sealed space between said cover element and said receptacle.

2. The household appliance according to claim 1, wherein said sealing element is built as a gasket.

3. The household appliance according to claim 2, wherein said gasket is co-molded on said receptacle.

4. The household appliance according to claim 2, wherein said gasket comprises an L-shaped part and an elastically moveable lip, wherein in the assembled state, said moveable lip is in elastic contact with said cover element, such that the moveable lip extends towards the L-shaped part, and wherein in a disassembled state, said moveable lip is not in elastic contact with said cover element, such that the movable lip extends away from the L-shaped part.

5. The household appliance according to claim 1, whereby said receptacle comprises at least partially at its periphery a step structure.

6. The household appliance according to claim 5, whereby said receptacle comprises a frame with a wall which is essentially perpendicular to said cover element in an assembled state, and whereby said sealing element comprises an L-shaped part with one first side aligned parallel along said wall and one side perpendicular to said first side covering an edge of said wall which is facing said cover element.

7. The household appliance according to claim 6, said sealing element comprises an elastically moveable lip connected to said L-shaped part.

8. The household appliance according to claim 1, whereby said cover element is at least partially transparent.

9. The household appliance according to claim 1, wherein at least one electronic component is arranged in said receptacle.

10. The household appliance according to claim 9, wherein said electronic component is a display, and whereby said cover element is an at least partially transparent window.

11. The household appliance according to claim 10, whereby said display is arranged on a carrier element which is attached to said receptacle or to an electronic board.

12. The household appliance according to claim 9, wherein said electronic component is a user interface element.

13. The household appliance according to claim 12, wherein said user interface element is a capacitive touch-sensitive user interface element, and wherein the cover is a conductive film covering the interface element and facing the interface element.

14. The household appliance according to claim 1, whereby said frontal panel comprises a user interface.

* * * * *